US010731941B1

(12) United States Patent
Lin

(10) Patent No.: US 10,731,941 B1
(45) Date of Patent: Aug. 4, 2020

(54) KICKBACK STRUCTURE FOR A TOY GUN

(71) Applicant: LI CHENG TECHNIQUE BUSINESS COMPANY, Changhua County (TW)

(72) Inventor: Yu-Cheng Lin, Changhua County (TW)

(73) Assignee: LI CHENG TECHNIQUE BUSINESS COMPANY, Changhua County (TW)

( * ) Notice: Subject to any disclaimer, the term of this patent is extended or adjusted under 35 U.S.C. 154(b) by 0 days.

(21) Appl. No.: 16/254,555

(22) Filed: Jan. 22, 2019

(51) Int. Cl.

| | |
|---|---|
| ***F41A 33/06*** | (2006.01) |
| ***F41B 11/642*** | (2013.01) |
| ***F41B 11/644*** | (2013.01) |
| ***F41B 11/646*** | (2013.01) |

(52) U.S. Cl.
CPC ..... *F41A 33/06* (2013.01); *F41B 11/642* (2013.01)

(58) Field of Classification Search
CPC ..... F41A 33/00; F41A 3/70; F41B 11/642; F41B 11/64; F41B 11/644; F41B 11/646; F41B 7/00; F41B 7/003; F41B 7/08
See application file for complete search history.

(56) References Cited

U.S. PATENT DOCUMENTS 7,100,592 B1 * 9/2006 Yang ..... F41B 7/00 124/67
7,694,448 B2 * 4/2010 Iwasawa ..... F41B 11/89 124/54
8,297,269 B2 * 10/2012 Hu ..... F41B 11/646 124/67
2006/0137671 A1 * 6/2006 Chu ..... F41B 7/08 124/32
2008/0155875 A1 * 7/2008 Iwasawa ..... F41B 11/644 42/54
2008/0156309 A1 * 7/2008 Kung ..... F41A 3/72 124/31
2010/0065032 A1 * 3/2010 Yang ..... F41B 11/57 124/27
2011/0192386 A1 * 8/2011 Hu ..... F41B 11/646 124/32
2011/0192387 A1 * 8/2011 Hu ..... F41B 11/646 124/80
2011/0283984 A1 * 11/2011 Hu ..... F41B 11/57 124/77
2011/0287388 A1 * 11/2011 Hu ..... F41A 33/06 434/18
2012/0138038 A1 * 6/2012 Lee ..... F41B 11/644 124/80
2012/0240912 A1 * 9/2012 Hu ..... F41B 11/646 124/80

(Continued)

*Primary Examiner* — Derrick R Morgan

(57) ABSTRACT

A kickback structure for a toy gun, the toy gun has a body portion and a barrel connected to the barrel, the handle portion is provided with the handle and the trigger assembly, and has a chamber inside. A piston is pushed forward by a first spring, and the a front and the back of the body portion are respectively provided with an aiming base and a fixed base, and the aiming base is provided with a through hole at the center, and the through hole is provided with a sliding sleeve, and the sliding sleeve is internally coupled between the sliding sleeve and the fixed base. A pushing rod is normally stretched by the second spring.

7 Claims, 6 Drawing Sheets

(56) References Cited

U.S. PATENT DOCUMENTS

| | | | | |
|---|---|---|---|---|
| 2015/0226513 | A1* | 8/2015 | Lin | F41B 7/08 124/17 |
| 2017/0276451 | A1* | 9/2017 | Kang | F41A 17/36 |
| 2018/0120049 | A1* | 5/2018 | Iwasawa | F41B 11/643 |
| 2019/0093977 | A1* | 3/2019 | Kim | A63H 5/04 |
| 2019/0113305 | A1* | 4/2019 | Johnson | F41B 11/70 |

* cited by examiner

KICKBACK STRUCTURE FOR A TOY GUN

BACKGROUND OF INVENTION

1. Field of Invention

The present invention relates to a toy gun, and more particularly to a kickback structure for a toy gun.

2. Description of the Related Art

The pace of modern life is fast, and the work or life stress often makes people unable to breathe. If pressure builds up and not able to release in time, it may affect physical and mental health. Toy gun shooting is an sport can be done alone or by group competition, which is a good way to relieve stress.

Most of the traditional toy guns only have the function of ejecting the projectiles and is not much about the realism feeling, so the player often cannot get the same gun while shooting.

Therefore, it is desirable to provide a kickback structure for a toy gun to mitigate and/or obviate the aforementioned problems.

SUMMARY OF THE INVENTION

An objective of present invention is to provide a kickback structure for a toy gun the toy gun has a body portion and a barrel connected to the barrel, the handle portion is provided with the handle and the trigger assembly, and has a chamber inside. A piston is pushed forward by a first spring, and the a front and the back of the body portion are respectively provided with an aiming base and a fixed base, and the aiming base is provided with a through hole at the center, and the through hole is provided with a sliding sleeve, and the sliding sleeve is internally coupled between the sliding sleeve and the fixed base. A pushing rod is normally stretched by the second spring.

Other objects, advantages, and novel features of invention will become more apparent from the following detailed description when taken in conjunction with the accompanying drawings.

DETAILED DESCRIPTION OF THE PREFERRED EMBODIMENT

Figure 1:
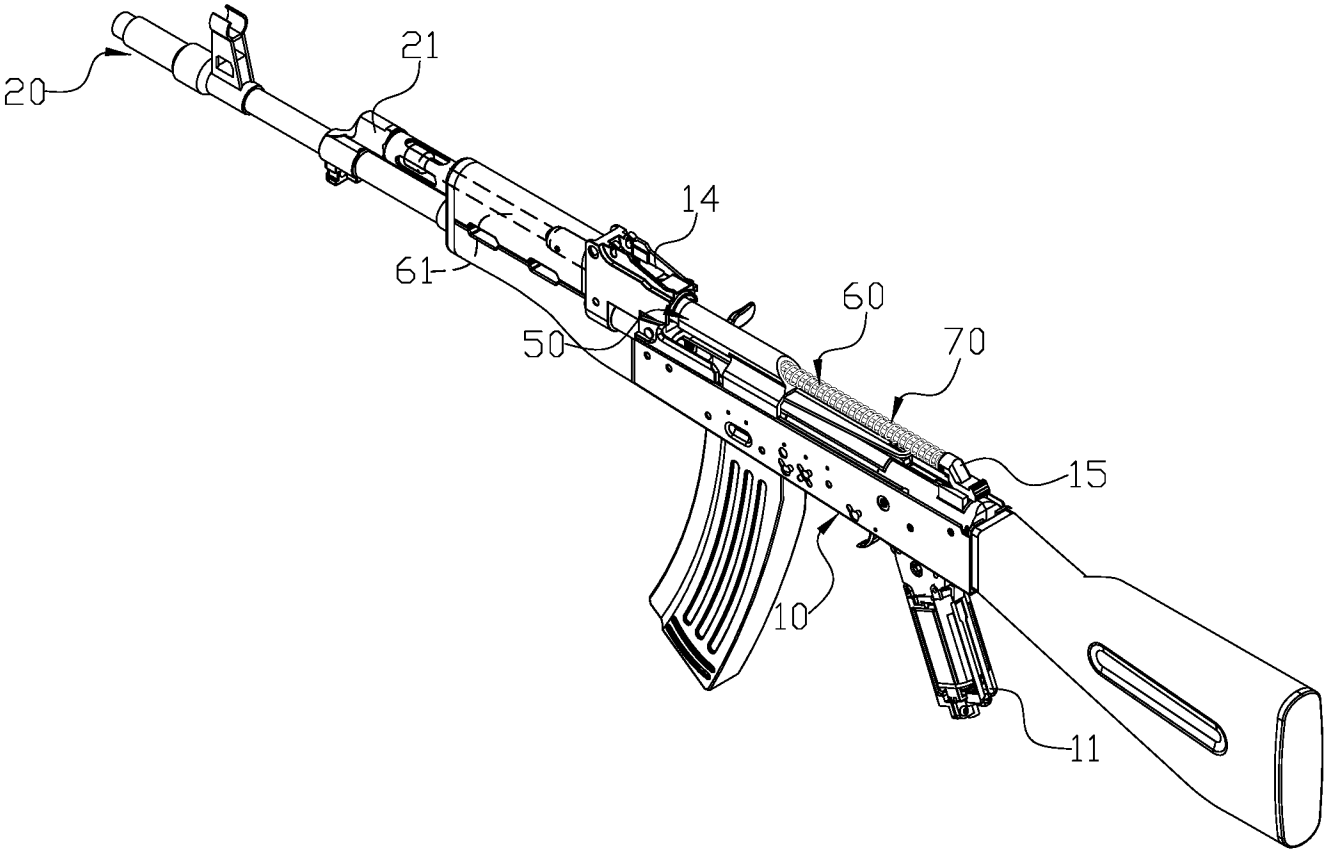
FIG. 1 is a three-dimensional assembly drawing of a preferred embodiment of the present invention.
Figure 2:
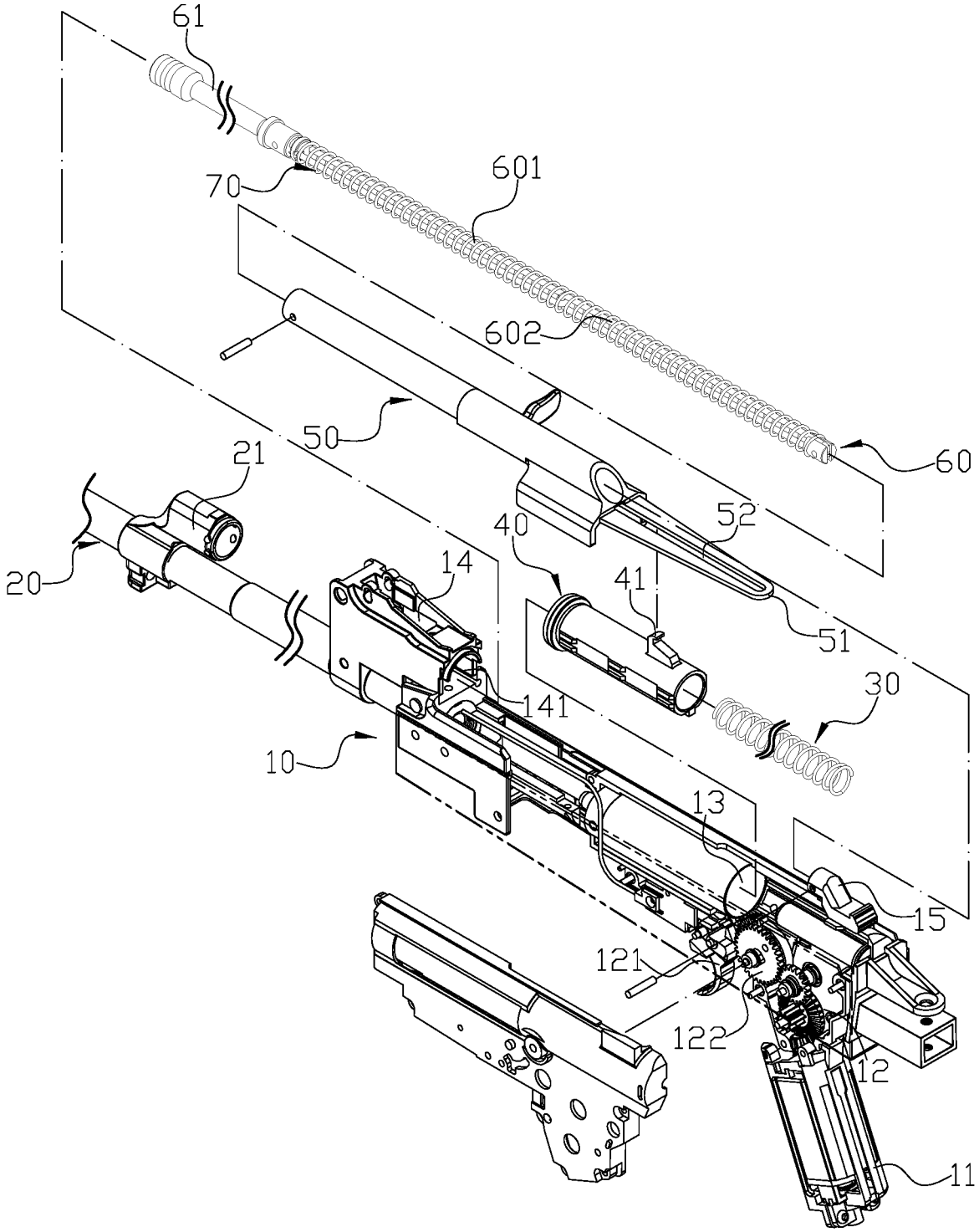
FIG. 2 is a three-dimensional exploded drawing of the preferred embodiment of the present invention.
Figure 3:
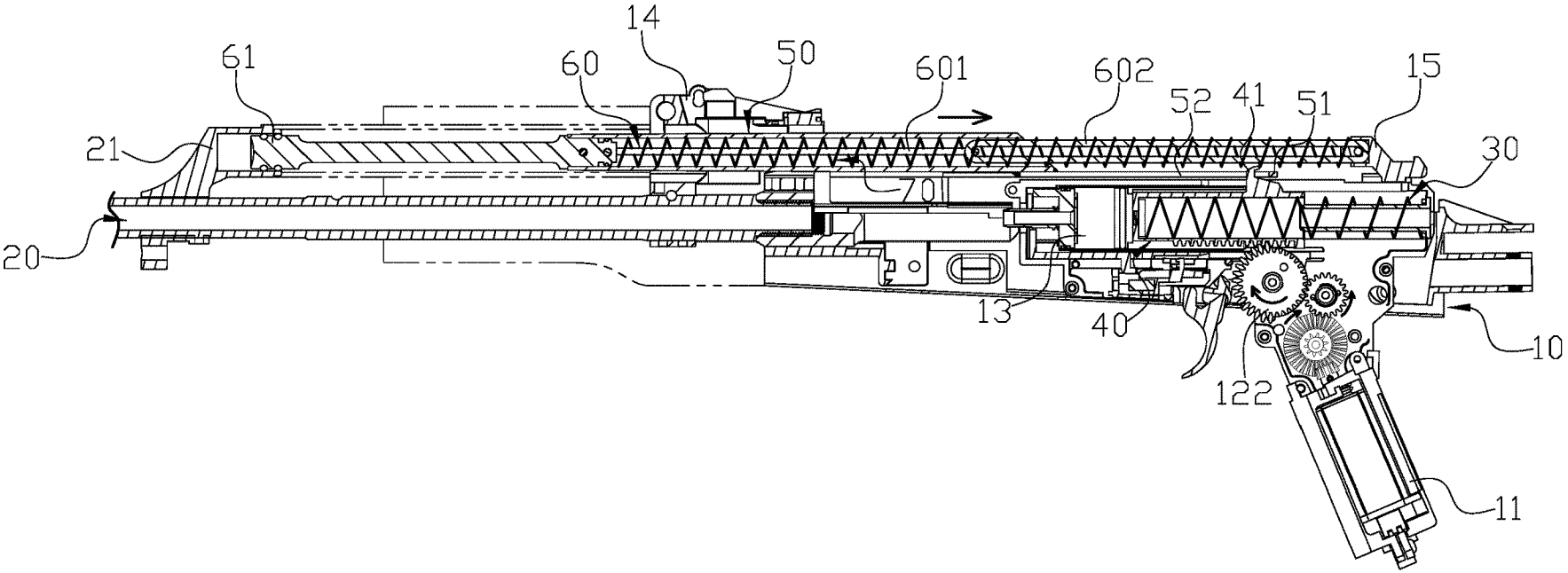
FIG. 3 shows when the trigger is pressed according to the preferred embodiment of the present invention.
Figure 4:
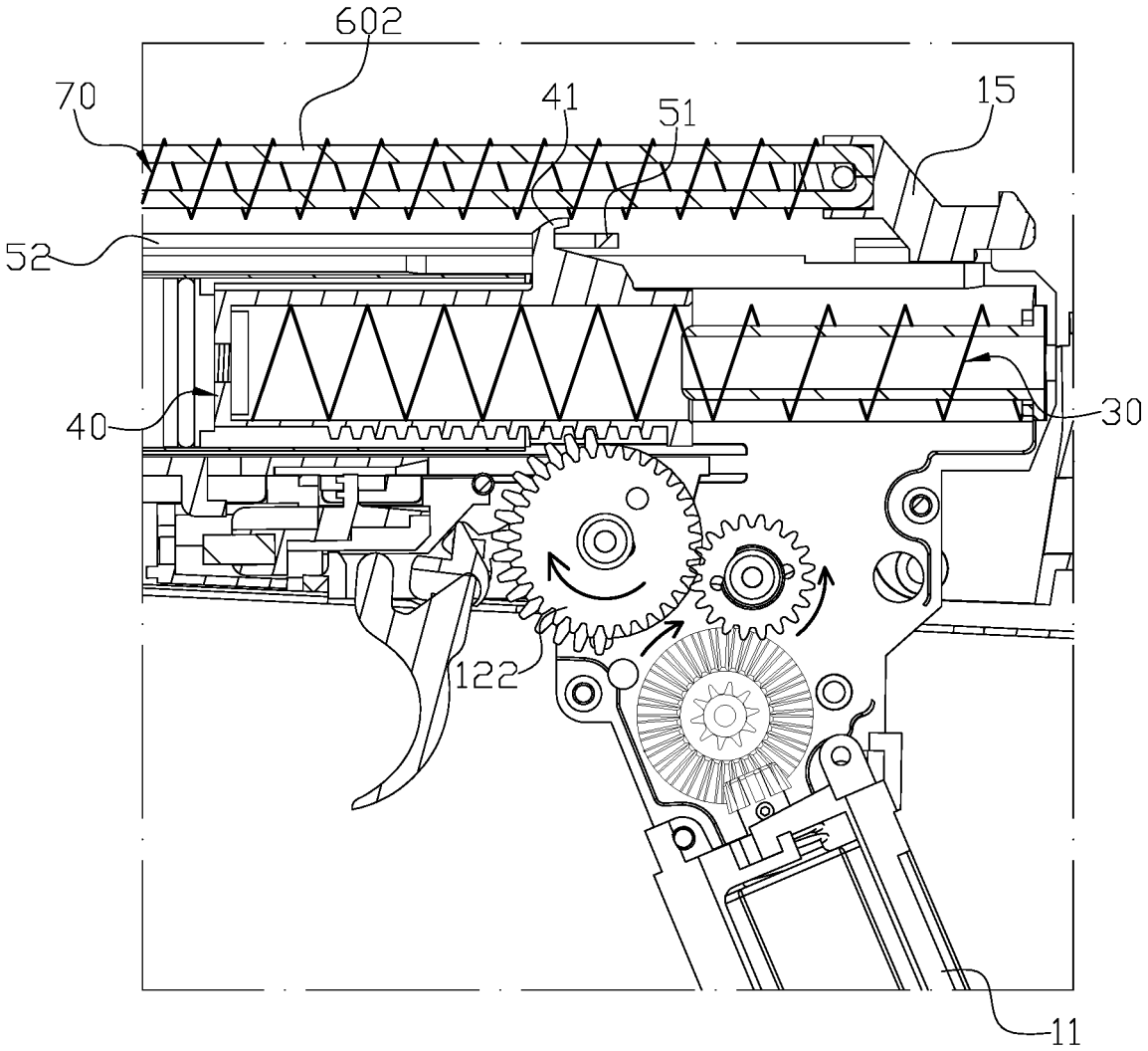
FIG. 4 is a partial enlarged view of FIG. 3.

First refer to FIGS. 1-4. In a preferred embodiment of the present invention, a kickback structure for a toy gun is disclosed, in which the toy gun has a body portion 10 and a barrel 20. The body portion 10 has a handle 11 and a trigger assembly 12 with a chamber 13. The chamber 13 is provided with a piston 40 pushed by a first spring 30 and connected to the trigger assembly 12. When the trigger 121 is pressed, a gear set 122 of the trigger assembly 12 drives the piston 40 to move backward. An idle section of the gear set 122 is distal from the piston 40, such that the piston 40 is subsequently pushed forward by the first spring 30 to eject a bullet in the chamber 13. Furthermore, an aiming base 14 and a fixed base 15 are respectively disposed at opposite ends of the body portion 10. The aiming base 14 is provided with a through hole 141 for accepting a sliding sleeve 50, and a pushing rod 60 is disposed in the sliding sleeve 50 and pushed by a second spring 70 when the sliding sleeve 50 engages the fixed base 15. Moreover, a connecting member 41 has a hook-like shape and extends from a rear end of the piston 40. A horizontal engaging member 51 extends from a bottom edge of the sliding sleeve 50, and a long aperture 52 is disposed in the horizontal member 51 and configured to accept the connecting member 41 to allow the piston 40 driven by the gear set 122 of the trigger assembly 12 via the connecting member 41 to move along the long aperture 52. When the piston 40 moves to cause contact between the connecting member 41 and a rear end of the long aperture 52, this also pushes the sliding sleeve 50; when the gear set 122 rotates to the idle section, this causes the first spring 30 and the second spring 70 to push back the piston 40 and the sliding sleeve 50. The pushing rod 60 further has a first U-shaped rod 601 and a second U-shaped rod 602 hooked with each other, and the second spring 70 is disposed around the first U-shaped rod 601 and the second U-shaped rod 602.

In the preferred embodiment of the present invention, the toy gun is shaped as a rifle.

In the preferred embodiment of the present invention, the piston 40 is provided with a toothed strip engaging with the gear set 122.

In the preferred embodiment of the present invention, the barrel 20 further comprises a connecting base 21, and the pushing rod 60 further comprises an extended portion 61 entering into the connection base 21.

In the preferred embodiment of the present invention, the pushing rod 60 is connected with the sliding sleeve 50 and the fixed base 15 via a connecting pin.

In the preferred embodiment of the present invention, the sliding sleeve 50 and the horizontal member 51 are an integral structure.

In the preferred embodiment of the present invention, the sliding sleeve 50 and the horizontal member 51 are two individual members.

In the preferred embodiment of the present invention, a bottom surface of the connecting member 41 is inclined.

Figure 5:
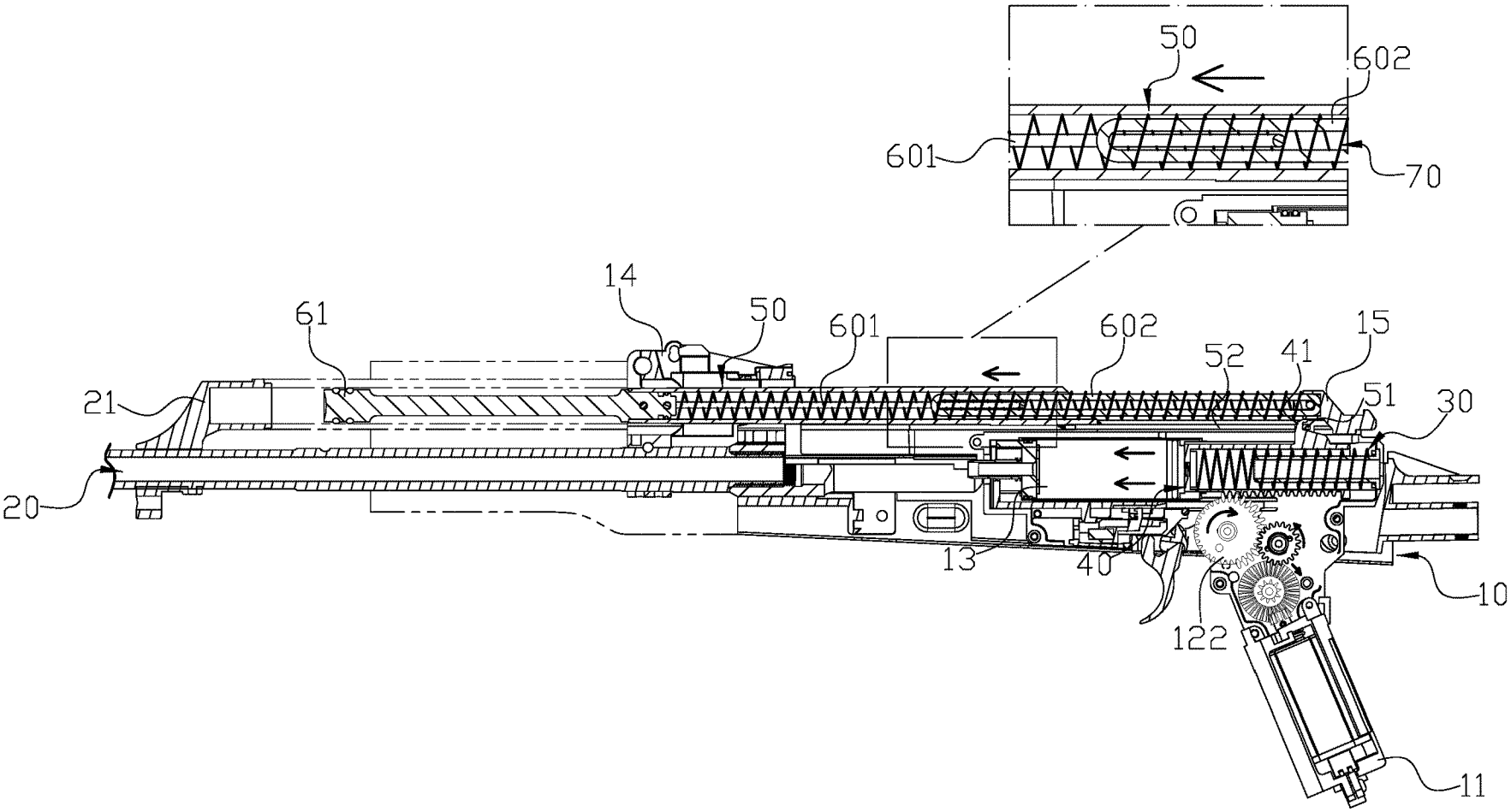
FIG. 5 is a partial enlarged view showing the first U-shaped rod being moved according to the preferred embodiment of the present invention.
Figure 6:
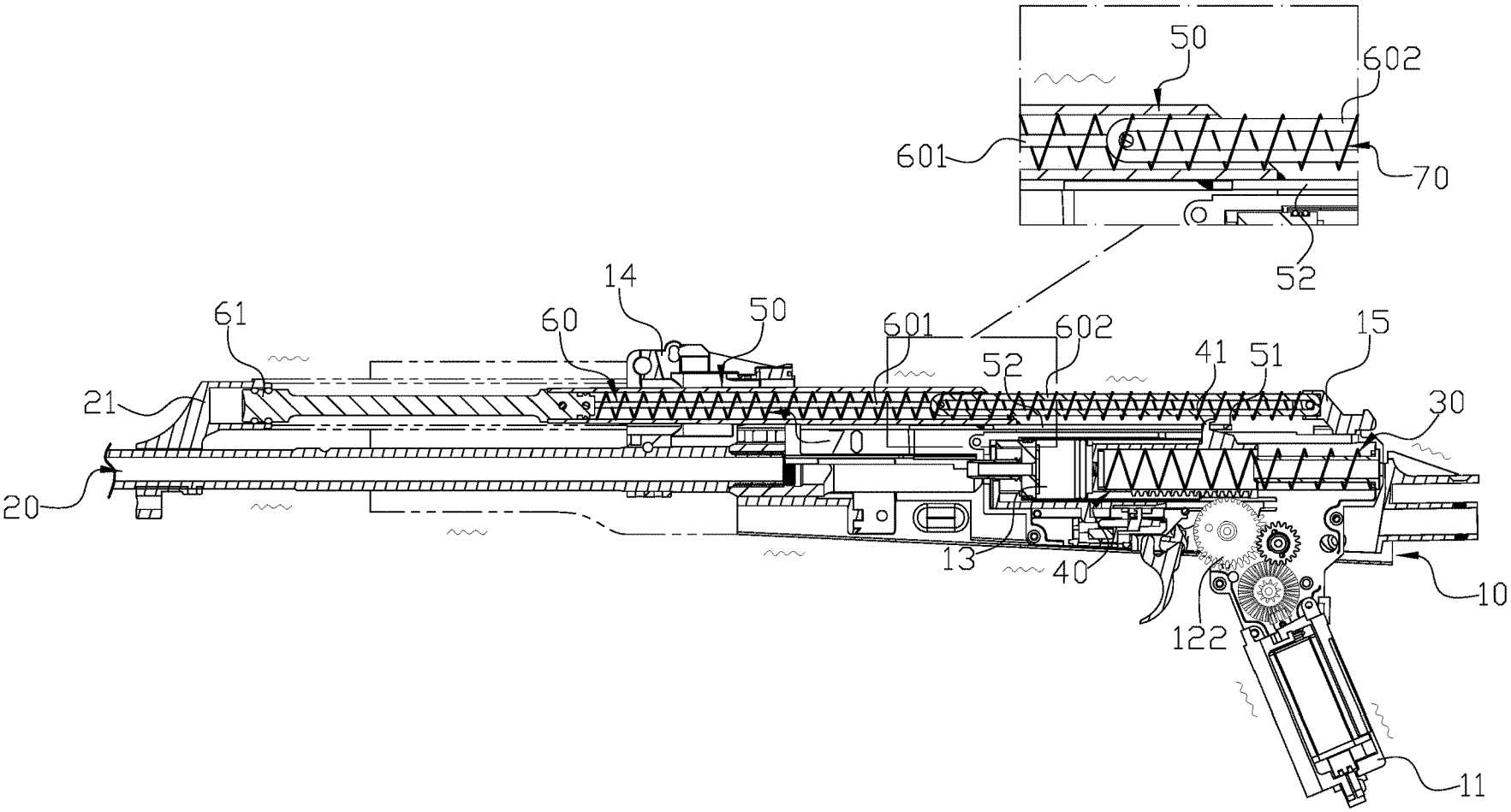
FIG. 6 is a partial enlarged view showing after shooting according to the preferred embodiment of the present invention.

With the above structure, when the trigger 121 is pressed to bring the sliding sleeve 50 back through the piston 40, the corner ends of the first U-shaped rod 601 and the second U-shaped rod 602 are distant from each other and simultaneously compress the second spring 70, as shown in FIG. 5. When the piston 40 is brought back by the first spring 30 and the bullet is fired, in an instant, the first U-shaped rod 601 can be brought back by the second spring 70 which allows the first U-shaped rod 601 to travel through the maximum stroke to make impact with the second U-shaped rod 602 to produces an immersive sound and vibration, as shown in FIG. 6. therefore, the shooting experience fully simulates the kickback effect, and the user will be able to enjoy as much as the real gun operation.

Although the present invention has been explained in relation to its preferred embodiment, it is to be understood that many other possible modifications and variations can be made without departing from the spirit and scope of invention as hereinafter claimed.

What is claimed is:

1. A toy gun with a kickback structure, the toy gun comprising:

a body portion and a barrel, the body portion having a handle, a chamber, and a trigger assembly with, the chamber comprising a piston pushed by a first spring, the piston connected to the trigger assembly;

wherein the trigger assembly is configured such that when the trigger is pressed, a gear set of the trigger assembly drives the piston to move backward, an idle section of the gear set being distal from the piston, such that the piston is subsequently by pushed forward by the first spring;

an aiming base and a fixed base respectively disposed at opposite ends of the body portion, the aiming base comprising a through hole for accepting a sliding sleeve, a pushing rod disposed in the sliding sleeve, the pushing rod pushed by a second spring when the sliding sleeve engages the fixed base;

wherein:

a connecting member comprises a hook extending from a rear end of the piston, and an engaging member extends from a bottom edge of the sliding sleeve, an extended aperture disposed in the engaging member and configured to accept the connecting member to allow the piston driven by the gear set of the trigger assembly via the connecting member to move along the extended aperture;

the piston is movable such that contact between the connecting member and a rear end of the extended aperture pushes the sliding sleeve;

the gear set is rotatable to the idle section to cause the first spring and the second spring to push back the piston and the sliding sleeve; and the pushing rod further comprises a first U-shaped rod and a second U-shaped rod hooked with each other, and the second spring is disposed around the first U-shaped rod and the second U-shaped rod.

2. The kickback structure for a toy gun as claimed in claim 1, wherein the toy gun is shaped as a rifle.

3. The kickback structure for a toy gun as claimed in claim 1, wherein the piston comprises a toothed strip engaging with the gear set.

4. The kickback structure for a toy gun as claimed in claim 1, wherein the barrel further comprises a connecting base, and the pushing rod further comprises an extended portion entering into the connection base.

5. The kickback structure for a toy gun as claimed in claim 1, wherein the pushing rod is connected with the sliding sleeve and the fixed base via a connecting pin.

6. The kickback structure for a toy gun as claimed in claim 1, wherein the sliding sleeve and the engaging member are an integral structure.

7. The kickback structure for a toy gun as claimed in claim 1, wherein the sliding sleeve and the engaging member are two individual members.

* * * * *